US005960594A

United States Patent [19]

Cronin

[11] Patent Number: 5,960,594

[45] **Date of Patent: *Oct. 5, 1999**

[54] METHOD AND APPARATUS FOR INSULATING STRUCTURES

[75] Inventor: John D. Cronin, 15 Lincoln St., Braintree, Mass. 02184-6013

[73] Assignee: John D. Cronin, Braintree, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,380

[22] Filed: Apr. 4, 1997

[51] Int. Cl.[6] ..... E04B 1/00

[52] U.S. Cl. ..... 52/99; 52/406.2; 52/204.1; 52/742.1

[58] Field of Search ..... 52/98, 99, 100, 52/742.1, 406.1, 406.2, 232, 204.1

*Primary Examiner*—Creighton Smith

*Attorney, Agent, or Firm*—Medlen & Carroll, LLP

[57] ABSTRACT

A self-contained device for filling voids in structures with insulating material is described. In particular, the present invention is useful for filling the weight pockets adjacent to windows in older buildings.

7 Claims, 3 Drawing Sheets

METHOD AND APPARATUS FOR INSULATING STRUCTURES

FIELD OF THE INVENTION

This invention relates to the manufacture and use of a self-contained device for filling voids in structures with insulating material. In particular, the present invention is useful for filling the weight pockets adjacent to windows.

BACKGROUND

Until recently, windows were built in buildings with a vertical void placed on either side of the window itself. In this void, a weight was attached to the window via a pulley and rope and used to counterbalance the weight of the window. The window could be partially or completely opened, and the weights would prevent the spontaneous closure of the window by gravity. The weights were designed to travel freely up and down the void as the window is closed and opened.

Today, newly manufactured windows use friction or some other method to remain open and no longer need counterbalance weights. However, when existing windows of the older design are replaced with the newer windows, the adjacent voids remain in the wall.

When unfilled, these voids can be a source of significant heat loss through the wall. As most windows are replaced for the purpose of energy conservation, the filling of these voids can be critical to the success of a window replacement project. The remaining voids must be filled with insulation in order to prevent significant heat loss through the wall.

Presently, these voids can be filled by injecting polyurethane foam into the void (see U.S. Pat. No. 5,273,693 to Rothwell et al.). However, foam injection entails significant cost due to the both the expense of the material and the handling difficulties associated with this potentially toxic substance.

What is needed is a simple, effective method of filling voids in structures with insulating material.

SUMMARY OF THE INVENTION

The present invention relates to devices and methods for filling voids with insulating material. In one embodiment, the apparatus comprises a) a housing, b) insulating material encased in the housing and c) a breaching means associated with the housing. While the present invention is not limited to the material comprising the housing, it can be comprised of any suitable material, including, but not limited to, paper or polyethylene. In such embodiments, the housing may be scored.

While the present invention is not limited by the nature of the breaching means, in one embodiment it is a cord suitable for tearing the housing as needed. In such an embodiment, the examples of materials that such a cord can be made from include, but are not limited to, string, plastic or wire. In an embodiment that utilizes a cord, preferably it is longitudinally encased in (or attached to) the housing.

While the present invention is not limited to the type of insulating material utilized, in one embodiment, it is fiberglass. Additionally, while it is not necessary to carry out the present invention, in a preferred embodiment the insulating material is compressed in the housing (i.e., packed in a compressed state).

One embodiment of the manufacturing methods contemplated by the present invention comprise a) providing a housing, insulating material, and a breaching means; b) encasing the insulating material in the housing; and c) associating the breaching means with the housing. While not required to practice the methods contemplated by the present invention, the housing, insulating material and breaching means can have the same characteristics as described above.

One embodiment of the methods for using an insulating device contemplated by the present invention comprise a) providing i) a structure having a void and ii) a device comprising a) a housing, b) insulating material encased in said housing, and c) a breaching means associated with said housing; and b) inserting said device into a void. While not required to practice the methods contemplated by the present invention, the housing, insulating material and breaching means can have the same characteristics as described above.

DEFINITIONS

Figure 1:
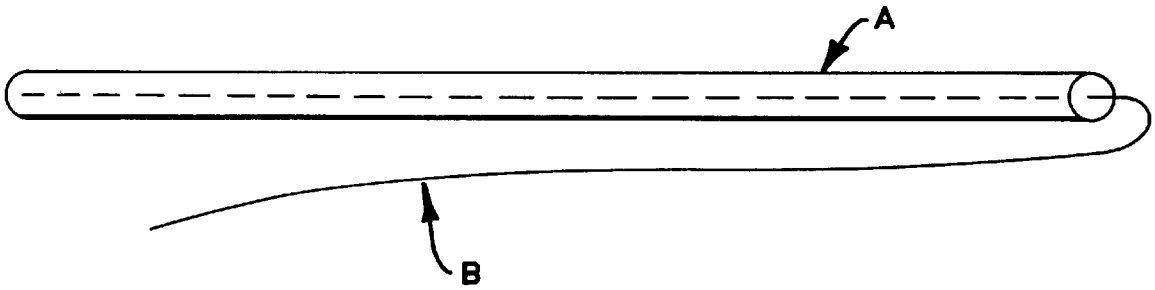
FIG. 1 is a side view representation of one embodiment of the devices of the present invention. The outer wrapper or housing A is shown to contain an imbedded rip cord B that can be pulled to breach the integrity of the housing.
Figure 2:
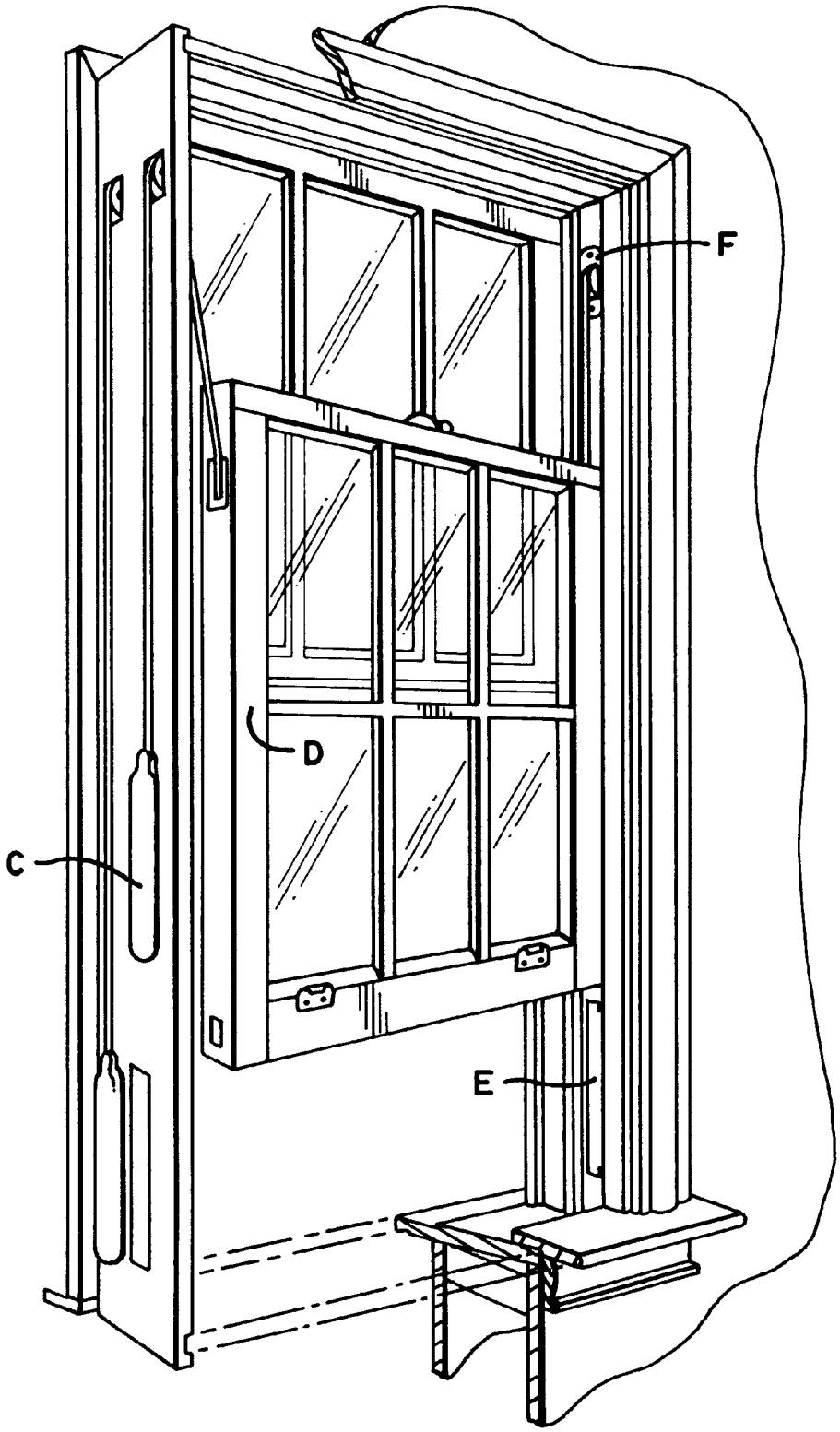
FIG. 2 is an illustration of a representative window frame containing counterweights C. With the window D removed, the void access plate E and pulley plate F can be removed for insertion of the insulating apparatus.
Figure 3:
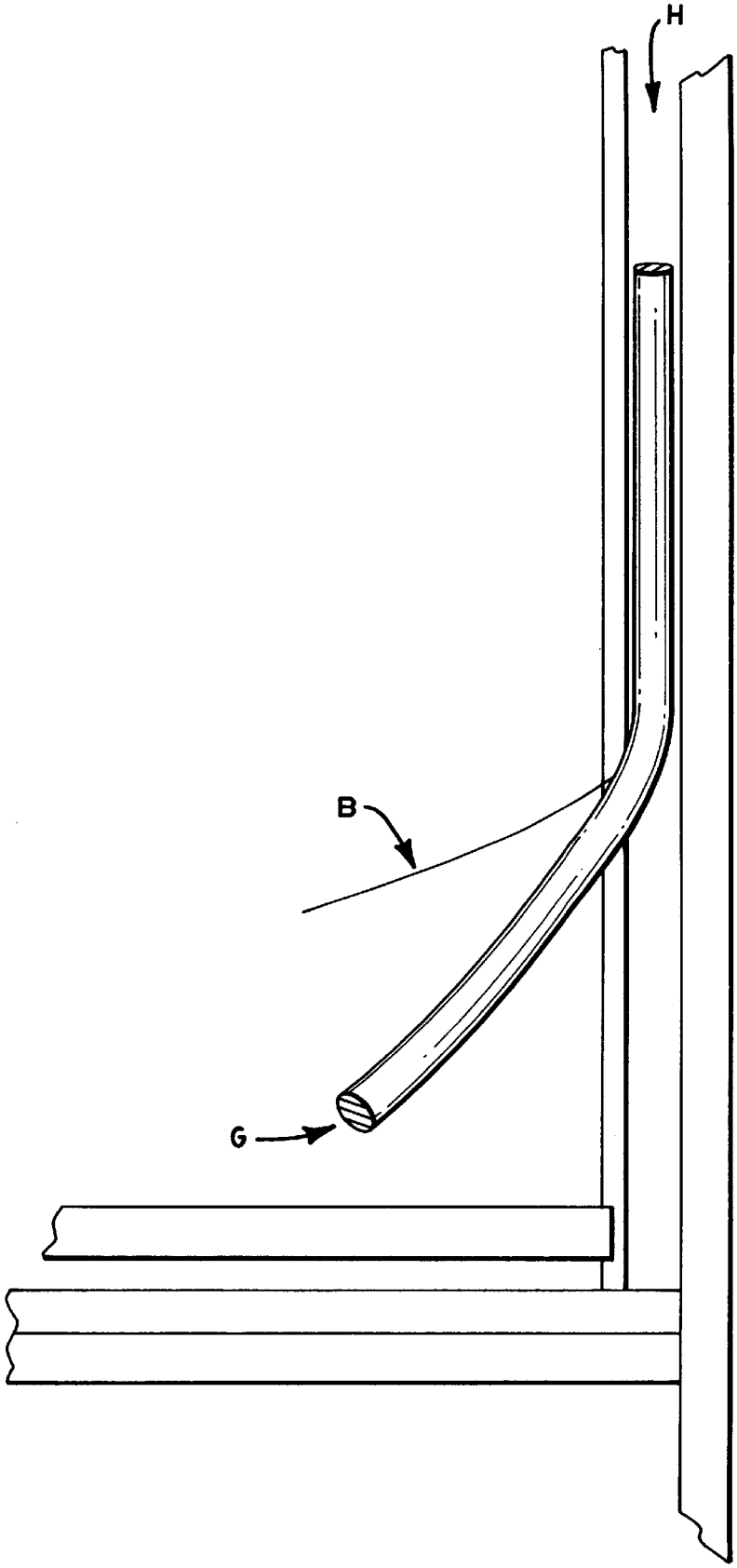
FIG. 3 is a cut away view as an illustration of how one embodiment of the devices of the present invention is inserted. The device G containing insulating material can be cut to match the height of the void H. The device can then be inserted through the access plate hole (not shown). After insertion, the rip cord B is pulled to release the compressed insulation material.

"Insulating material" means a material that exhibits resistance to the conductivity of heat as compared to air (e.g., fiberglass, foam, rubber, etc.).

A "housing" is an element capable of encasing insulating material. In one embodiment, the housing is wrapped around the material (i.e., a "wrapper").

"Longitudinally scored" describes the nature of small marks (grooves, scratches, notches, etc.) placed along at least a portion of the length of the housing marked and designed to create weak points in the marked housing.

"Longitudinally encased" describes the nature of the disposition of the material to be encased as being disposed within at least a portion of the length of the substrate containing that material.

"Breaching means" refers to a means for breaking the structural integrity of a housing. For example, longitudinally scoring of a housing can cause a housing to break open when pressure is applied, a cord that is longitudinally encased in a housing can break open the housing when it is pulled, etc.

"Associated with the housing" means that the means at issue is imbedded in or attached to the housing (e.g., by making appropriate marks or utilizing epoxy glue).

"Void" refers to an empty space in a structure (e.g., in a wall, ceiling or floor) into which insulation can be inserted.

DESCRIPTION OF THE PREFERRED EMBODIMENTS

While it is not intended that the present invention be limited by particular materials, insulating material is that which can be compressed and that which can subsequently re-expand when the compressing force is released. While the present invention is not limited to any particular insulation material, fiberglass insulation sold under the name Miraflex Fiber and manufactured by Owens-Corning (Toledo, Ohio) is preferred. This material is a fiber glass wool consisting of fibrous glass (CAS No. 65997-17-3). Additionally, any insulating material with adequate ability to expand after compressibility will be suitable for the preferred embodiments of the present invention.

The insulating material should be compressed and wrapped with a suitable wrapping material. A method of wrapping insulation for shipping is disclosed in U.S. Pat. No. 3,521,742 to Ferrell and is hereby incorporated by reference. While it is not intended that the present invention be limited to any particular wrapping material, such material should have the resilience necessary for wrapping compressed insulation material while still capable of being ruptured to release the compressed material. For example, paper is suitable as a wrapping material, and the economic value of the polyethylene as found in common grocery bags makes it a preferred wrapping material.

It is not intended that the present invention be limited by the shape of the device and the wrapped insulation device may be square, round, oblong or any desired shape. The present invention is also not limited by the length of the device. In fact, it may be predesigned for suitability to fill a particular length void. Alternatively, it can be made such that the installer can custom cut it to any desired length.

In one embodiment, the device of the present invention may have one or more of various breaching means associated with the housing. For example, the wrapping material may be scored to allow for uniform rupture along its length. Alternatively, a pull string may be imbedded along the length of the device to promote uniform and complete rupture of the packaging. In this embodiment, this pull string may be composed of standard string, wire, plastic or any other material suitable for rupturing the wrapping material and is imbedded in the housing by gluing it with epoxy or other suitable glue to the inside of the housing. In a preferred embodiment, the string should be of a suitable length to allow for a loose end to be accessible for pulling after the device is inserted into the void. In these embodiments, the scoring and pull string can be utilized independently or in conjunction with one another.

One of the methods contemplated by the present invention is to use the device to fill voids in structures. In a preferred embodiment, its dimensions (e.g., length) is chosen based upon the dimensions (e.g., length) of the void to be filled. In such an embodiment, if necessary, the device may be cut to the proper length. The device is then inserted into the void by placing it through a hole in the wall of the void. While the present invention is not limited to the method of opening the device, the device housing can be ruptured by cutting the housing, breaching the scoring of the device housing, or by the pulling of a pull string imbedded in the housing or a combination of the above methods. The insulation material then fills the void based upon the nature of its compression and re-expansion characteristics.

The following examples serve to illustrate certain preferred embodiments and aspects of the present invention and are not to be construed as limiting the scope thereof.

EXAMPLE A

Paper Wrapped Device

Newspaper gauge paper is spread out upon a flat surface. A length of string is chosen based upon the length of the finished device and size of the void to be filled. As a guide, a string that is twice the length of the void should allow insertion of the finished device with the loose end of the string accessible for pulling. The string is placed in a straight line along a long edge of the paper with one end of the string extending beyond the top of the paper and the other end flush with the bottom of the paper. The portion of the string that is in contact with the paper is then glued to the paper along its length using epoxy or other suitable glue. After the glue has dried, fiberglass insulation material is then compressed and rolled in the paper under pressure. The rolling of the paper should begin at the long edge to which the string is now attached as this will ensure that the string is fully within the finished device.

The device may then be cut to suit the length of the void to be filled. Preferably, the end of the device from which the loose end of the string does not extend is cut. The end of the device from which the loose portion of the string extends is then inserted in one end of the void. The string is then pulled sharply to tear the paper and allow the fiberglass insulation to reexpand and fill the void.

EXAMPLE B

Polyethylene Wrapped Device

Grocery bag gauge polyethylene is spread out upon a flat surface. A length of string is chosen based upon the length of the finished device and size of the void to be filled. As a guide, a string that is twice the length of the void should allow insertion of the finished device with the loose end of the string accessible for pulling. The string is placed in a straight line along a long edge of the polyethylene with one end of the string extending beyond the top edge of the polyethylene and the other end flush with the bottom edge of the polyethylene. The portion of the string that is in contact with the polyethylene is then glued to the polyethylene along its length using epoxy or other suitable glue. After the glue has dried, fiberglass insulation material is then compressed and rolled in the polyethylene under pressure. The rolling of the polyethylene should begin at the long edge to which the string is now attached as this will ensure that the string is fully within the finished device.

The device may then be cut to suit the length of the void to be filled. Preferably, the end of the device from which the loose end of the string does not extend is cut. The end of the device from which the loose portion of the string extends is then inserted in one end of the void. The string is then pulled sharply to tear the polyethylene and allow the fiberglass insulation to reexpand and fill the void.

EXAMPLE C

Scored Paper Wrapped Device

Newspaper gauge paper is spread out upon a flat surface. A length of string is chosen based upon the length of the finished device and size of the void to be filled. As a guide, a string that is twice the length of the void should allow insertion of the finished device with the loose end of the string accessible for pulling. The string is placed in a straight line along a long edge of the paper with one end of the string extending beyond the top edge of the paper and the other end flush with the bottom edge of the paper. The portion of the string that is in contact with the paper is then glued to the paper along its length using epoxy or other suitable glue. After the glue has dried, fiberglass insulation material is then compressed and rolled in the paper under pressure. The rolling of the paper should begin at the long edge to which the string is now attached as this will ensure that the string is fully within the device. After rolling, the paper housing is scored along the length of the string by making small interspaced cuts.

The device may then be cut to suit the length of the void to be filled. Preferably, the end of the device from which the loose end of the string does not extend is cut. The end of the device from which the loose portion of the string extends is then inserted in one end of the void. The string is then pulled sharply to tear the paper along the scoring and allow the fiberglass insulation to reexpand and fill the void.

EXAMPLE D

Scored Polyethylene Wrapped Device

Grocery bag gauge polyethylene is spread out upon a flat surface. A length of string is chosen based upon the length of the finished device and size of the void to be filled. As a guide, a string that is twice the length of the void should allow insertion of the finished device with the loose end of the string accessible for pulling. The string is placed in a straight line along a long edge of the polyethylene with one end of the string extending beyond the top edge of the polyethylene and the other end flush with the bottom edge of the polyethylene. The portion of the string that is in contact with the polyethylene is then glued to the polyethylene along its length using epoxy or other suitable glue. After the glue has dried, fiberglass insulation material is then compressed and rolled in the polyethylene under pressure. The rolling of the polyethylene should begin at the long edge to which the string is now attached as this will ensure that the string is fully within the device. After rolling, the polyethylene housing is scored along the length of the string by making small interspaced cuts.

The device may then be cut to suit the length of the void to be filled. Preferably, the end of the device from which the loose end of the string does not extend is cut. The end of the device from which the loose portion of the string extends is then inserted in one end of the void. The string is then pulled sharply to tear the polyethylene along the scoring and allow the fiberglass insulation to reexpand and fill the void.

From the above description and examples, it is clear that the present invention contemplates devices and methods for a simple and effective way to fill voids in structures with insulating material.

I claim:

1. A method for insulating, comprising:

a) providing:

i) a window frame comprising a void access plate and a pulley plate, and ii) a device comprising a) a housing, b) insulating material encased in said housing, and c) breaching means associated with said housing;

b) removing said void access plate and said pulley plate to reveal a void; and c) inserting said device into said void.

2. The method of claim 1, wherein said housing is a wrapper manufactured from a material selected from the group consisting of paper and polyethylene.

3. The method of claim 2, wherein said wrapper is scored.

4. The method of claim 1, wherein said breaching means comprises a cord.

5. The method of claim 4, wherein said cord comprises a material selected from the group consisting of string, plastic and wire.

6. The method of claim 4, wherein said cord is longitudinally encased in said housing.

7. The method of claim 1, wherein said insulating material comprises fiberglass.

* * * * *